US007178442B2

(12) United States Patent
Yogev

(10) Patent No.: US 7,178,442 B2
(45) Date of Patent: Feb. 20, 2007

(54) DETACHABLE HANGER

(75) Inventor: Moshe Yogev, Kiryat Bialik (IL)

(73) Assignee: Rafael-Armament Development Authority, Ltd, Haifa (IL)

( * ) Notice: Subject to any disclaimer, the term of this patent is extended or adjusted under 35 U.S.C. 154(b) by 0 days.

(21) Appl. No.: 11/227,670

(22) Filed: Sep. 15, 2005

(65) Prior Publication Data

US 2006/0162535 A1 Jul. 27, 2006

(30) Foreign Application Priority Data

Dec. 16, 2004 (IL) ..... 165812

(51) Int. Cl.
*B64D 1/06* (2006.01)

(52) U.S. Cl. ..... 89/1.59; 89/1.812; 89/37.19; 244/137.4

(58) Field of Classification Search ..... 89/1.59, 89/1.54, 4.53, 1.51, 1.806, 1.807, 1.808, 89/1.812
See application file for complete search history.

(56) References Cited

U.S. PATENT DOCUMENTS 3,181,908 A * 5/1965 Clark ..... 294/82.26
4,184,408 A * 1/1980 Smith et al. ..... 89/1.806
4,829,876 A * 5/1989 Witt ..... 89/1.53
4,911,059 A * 3/1990 Brueckner ..... 89/1.819
4,976,183 A * 12/1990 Norrvi et al. ..... 89/1.819
5,497,691 A 3/1996 Graham
5,831,200 A 11/1998 Fisch
5,970,842 A * 10/1999 Knapp et al. ..... 89/1.54
6,276,277 B1 * 8/2001 Schmacker ..... 102/384
6,408,762 B1 * 6/2002 Schmacker et al. ..... 102/382
6,543,328 B1 * 4/2003 Plummer et al. ..... 89/1.54

* cited by examiner

*Primary Examiner*—Michael J. Carone
*Assistant Examiner*—Stewart T. Knox
(74) *Attorney, Agent, or Firm*—Ohlandt, Greeley, Ruggiero & Perle, L.L.P.

(57) ABSTRACT

The invention is a detachable hanger assembly for attaching a flying object to a launch rail on a launch platform. The detachable hanger assembly is attached to the flying object by one or more bolts and is adapted to slide in a slot in the launch rail when the flying object is launched. When the flying object is launched, the detachable hanger assembly slides in the slot until it impacts upon a stopper, which is fixedly located in the slot. The force of the impact of the hanger assembly with the stopper creates shearing forces that break one or more of the bolts thereby separating the main body section of the hanger assembly from the flying object.

5 Claims, 11 Drawing Sheets

DETACHABLE HANGER

FIELD OF THE INVENTION

The present invention is related to the field of hangers for rail-launched flying objects. In particular the invention is related to detachable hangers, which minimize the drag on the flying object once it leaves the launcher.

BACKGROUND OF THE INVENTION

One method of launching flying objects such as missiles from a land, sea, or airborne platform makes use of a rail mounted rigidly to the platform and to which the missile is attached. The rail has the dual function of supporting the missile as it is conveyed to the launch site and also to guide the missile in the first stage of its independent flight. The missile is typically attached to the rail by means of two or more elements known as "hangers". The hangers generally comprise elements shaped to match and slid in slots in the rail.

Typical hangers of this type are described in, for example, U.S. Pat. Nos. 5,831,200 and 5,970,842 . FIG. 1 and FIG. 2, taken from the first of these patents, show respectively perspective and front views of the hanger. The hangers are permanently attached to the body of the missile with bolts or other means that are not shown in the figures. Other hanger designs and rails designed to be compatible with them are described in U.S. Pat. No. 5,497,691.

When the missile is launched the hangers remain attached to its body. The generally un-aerodynamic shape of the hangers contributes an additional factor of drag to the flight. Wind tunnel tests have shown the additional drag to be on the order of 10% to 15%. Reducing the magnitude of the drag caused by the hangers would improve the performance of the missile and therefore be very advantageous.

It is a purpose of the present invention to provide a hanger for rail-launched flying objects that contributes a lower factor of drag to the object than that contributed by prior art hangers.

It is a further purpose of the present invention to provide a hanger for rail-launched flying objects that can be retro-fitted to existing flying objects.

Further purposes and advantages of this invention will appear as the description proceeds.

SUMMARY OF THE INVENTION

The present invention provides a detachable hanger, the use of which results in a reduction of the drag factor of flying objects that have been launched with the aid of a rail attached to a launch platform. The rail is rigidly attached to the launch platform and has the dual functions of supporting the missile as it is conveyed to the launch site and guiding the missile in the first stage of its independent flight. The flying object is attached to the rail by detachable hangers, which slide in a slot in the rail.

The flying object can be of any type including missiles, rockets, and manned or unmanned aircraft. The launch platform can be of any type, for example: land based, such as a truck, the deck of a ship, or an airplane.

The detachable hanger of the invention is not a monolithic device but an assembly comprised of a main body section and two or more clasps. The clasps are permanently attached to the body of the flying object. The main body of the hanger comprises a top with means for connecting it with the launch rail and a bottom, which has matching shape to that of the body of the flying object at the location at which the hanger is attached. The bottom may comprise outwardly projecting portions or grooves for aiding in the attachment of the main body section to the flying object. At the top of the main body section are two integrally formed projecting rails that fit into compatible grooves in the launch rail in order to attach the flying object to it during transport to the launch site and which, during the launch, slide in the grooves in order to guide the flying object in the first stage of flight. The clasps press against the bottom of the main body of the hanger and/or against/on the outwardly projecting portions attaching the main body of the hanger to the flying object. During the launch of the flying object, as the hanger assembly approaches the end of the rail, the clasps are rotated, thereby releasing the main body of the hanger from the flying object. In this manner, the objective of the invention is realized since, after launch, the main body of the hanger is detached from the flying object and remains attached to the rail on the launch platform and only the clasps, which have a significantly smaller profile than the entire hanger assembly, remain attached to the flying object.

The present invention is a detachable hanger assembly for attaching a flying object to a launch platform, which comprises a launch rail. The detachable hanger assembly is attached either directly or indirectly to the flying object by one or more bolts and is adapted to slide in a slot in the launch rail when the flying object is launched from the launch platform. When it slides in the slot the detachable hanger assembly impacts upon a stopper, which is fixedly located in the slot. The force of the impact of the hanger assembly with the stopper creates shearing forces that break one or more of the bolts that attach it to the flying object. When the bolts break, the main body section of the hanger assembly separates from the flying object.

A preferred embodiment of the detachable hanger assembly of the invention comprises a main body portion and two or more clasps. In this embodiment, the main body portion is attached to the flying object by means of the clasps and the clasps being attached to the flying object by at least two bolts. When the flying object is launched and the hanger impacts upon the stopper, the shearing forces break all but one of the bolts that attach each of the clamps to the flying object. This allows each of the clamps to be rotated about the unbroken bolt, thereby releasing the main body portion of the hanger assembly from the flying object.

In another embodiment of the detachable hanger assembly of the invention, the detachable hanger assembly comprises a main body portion that is attached to the flying object by means of one or more bolts. When the flying object is launched the force of impact creates shearing forces that break all of these bolts thereby releasing the main body portion of the hanger assembly from the flying object.

The detachable hanger assembly of the invention can be used to attach a missile, rocket, manned aircraft, or unmanned aircraft to a land-based, sea-based, or airborne platform.

All the above and other characteristics and advantages of the invention will be further understood through the following illustrative and non-limitative description of preferred embodiments thereof, with reference to the appended drawings.

BRIEF DESCRIPTION OF THE DRAWINGS

FIGS. 9A and 9B show another embodiment of the detachable hanger of the invention.

DETAILED DESCRIPTION OF PREFERRED EMBODIMENTS

Preferred embodiments of the present invention will be described in terms of a weapons system comprising a missile that is launched using a rail attached to an airplane. The skilled person will be able to utilize the description mutatis mutandis to enable him to design detachable hangers for any flying object that is launched using a rail attached to any type of launching platform. For brevity, the term "hanger assembly" and the word "hanger" will be used interchangeably in this application to describe the device of the invention.

Figure 3:
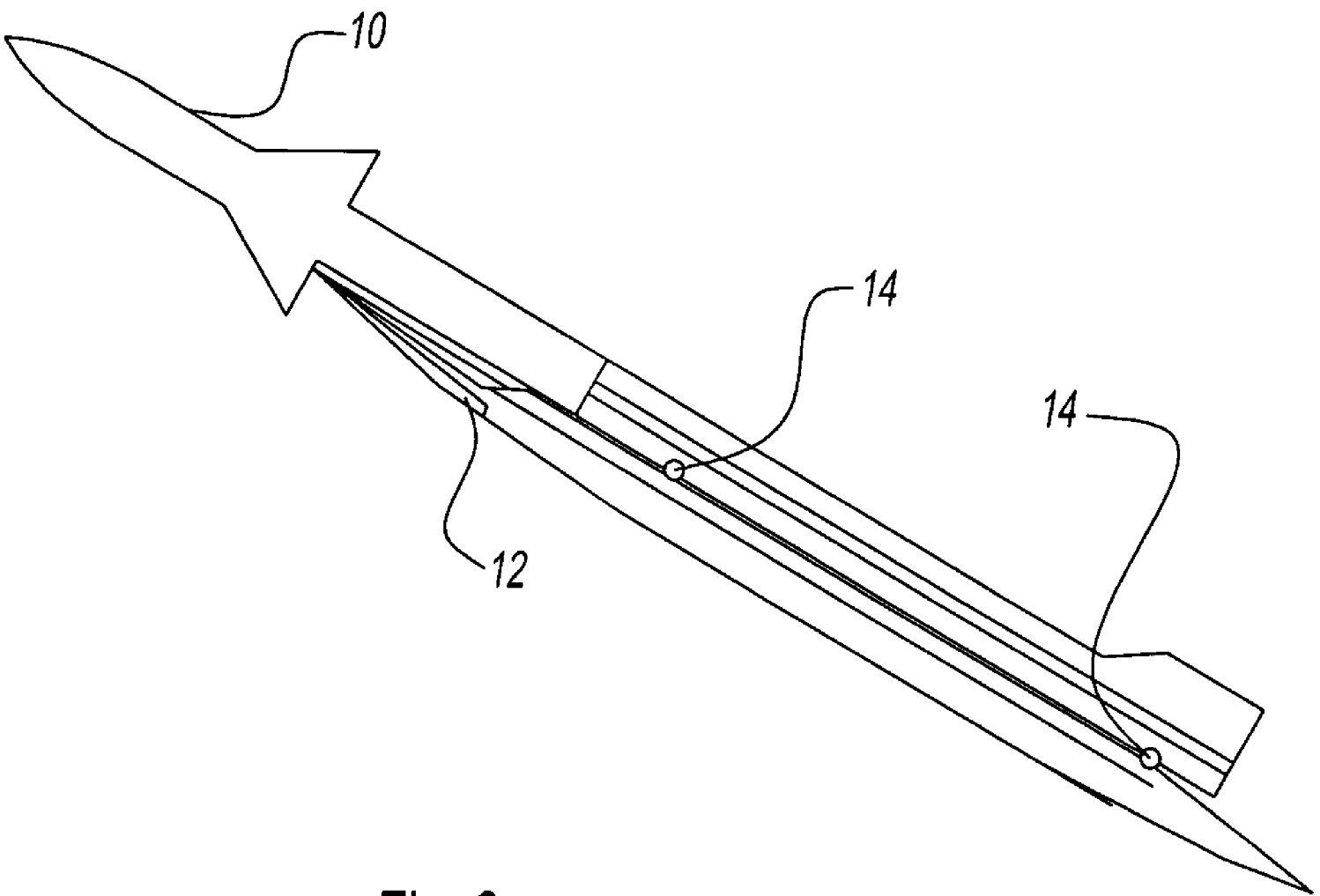
FIG. 3 shows a missile attached by means of two hangers to a launch rail.
Figure 4:
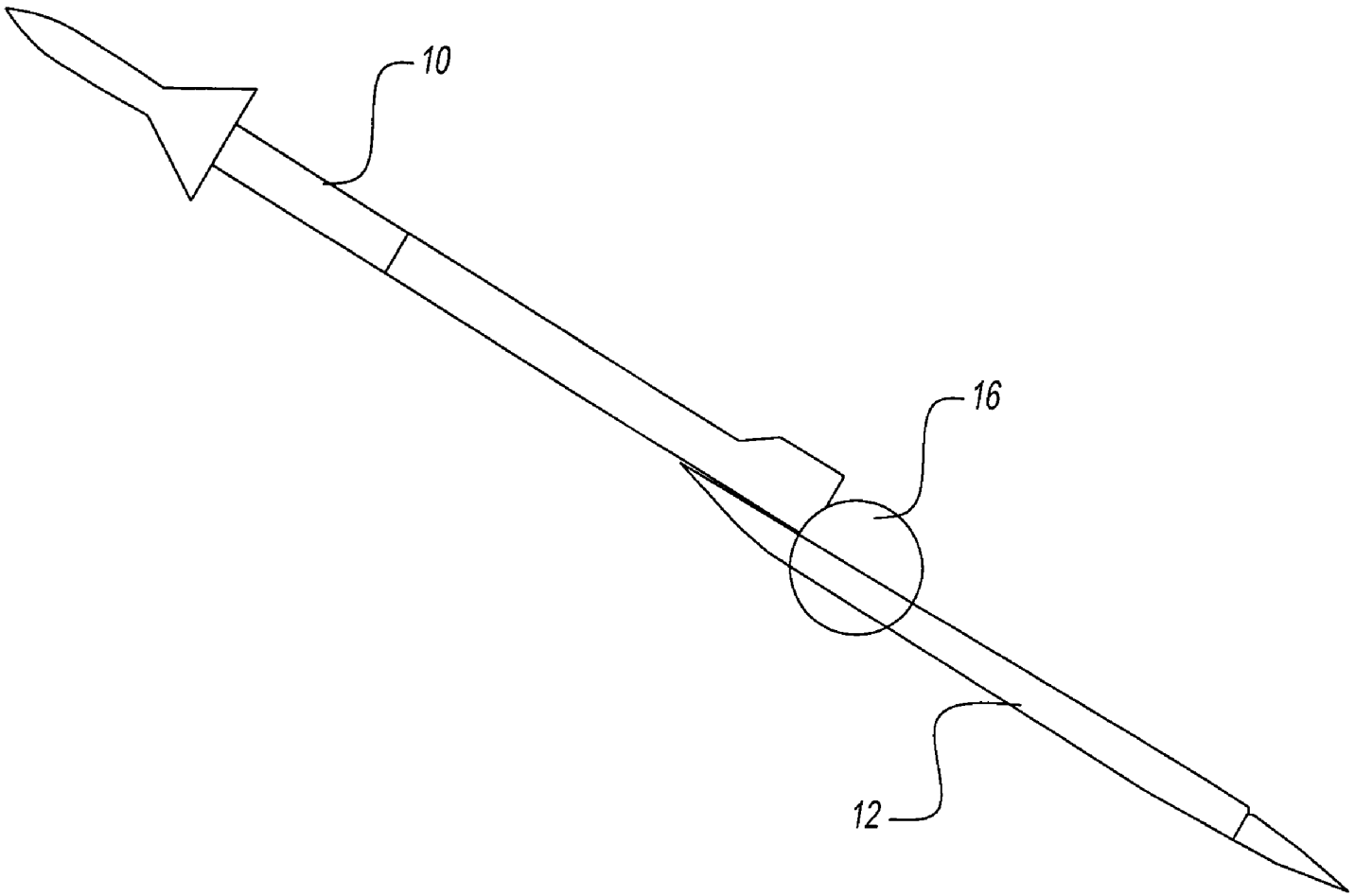
FIG. 4 shows a missile departing from the launch rail at the beginning of its flight.

In FIG. 3 is shown a missile 10 attached by means of two hangers 14 to launch rail 12, which is attached to an airplane that is not shown in the figure. FIG. 4 shows the missile 10 separating from launch rail 12 at the beginning of its flight. The area 16 of the rail is the area in which the main body portion of the hanger is detached by a process described hereinbelow, particularly with reference to FIGS. 7A and 7B.

Figure 5:
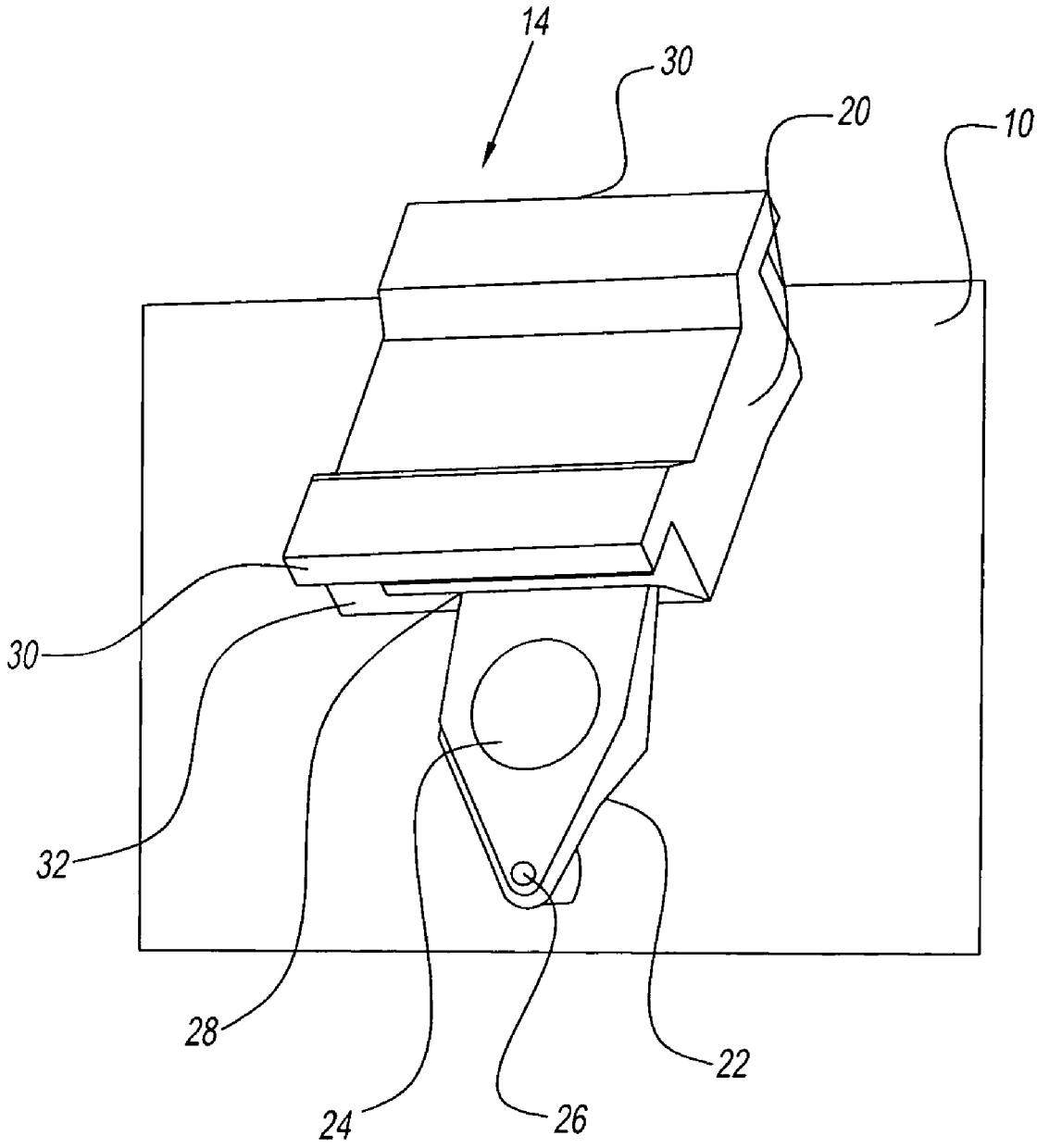
FIG. 5 shows a preferred embodiment of the hanger of the invention.

In FIG. 5 is shown a preferred embodiment of the hanger assembly 14 of the invention attached to a portion of the body of the missile 10. The hanger 14 is comprised of main body section 20 and two clasps 22. One clasp is located on each side of the main body section 20. The clasps 22 are attached to the missile by means of two bolts 24 and 26. End 28 of each clasp fits into groove 32 on the bottom of main body section 20 to firmly clamp main body section 20 to the missile 10. The main body section 20 is preferably made of a single block of material having a "T" shape as shown in FIG. 5, wherein the crossbar of the "T" forms two projecting rails 30. Main body section 20 fits into compatible "T"-shaped slot 42 in the launch rail (shown in cross-section in FIG. 7B), which is created on or parallel to the longitudinal axis of the launch rail. Projecting rails 30 slide in grooves 44 in slot 42 (FIG. 7B) thereby attaching the missile to the launch rail.

Figure 6A:
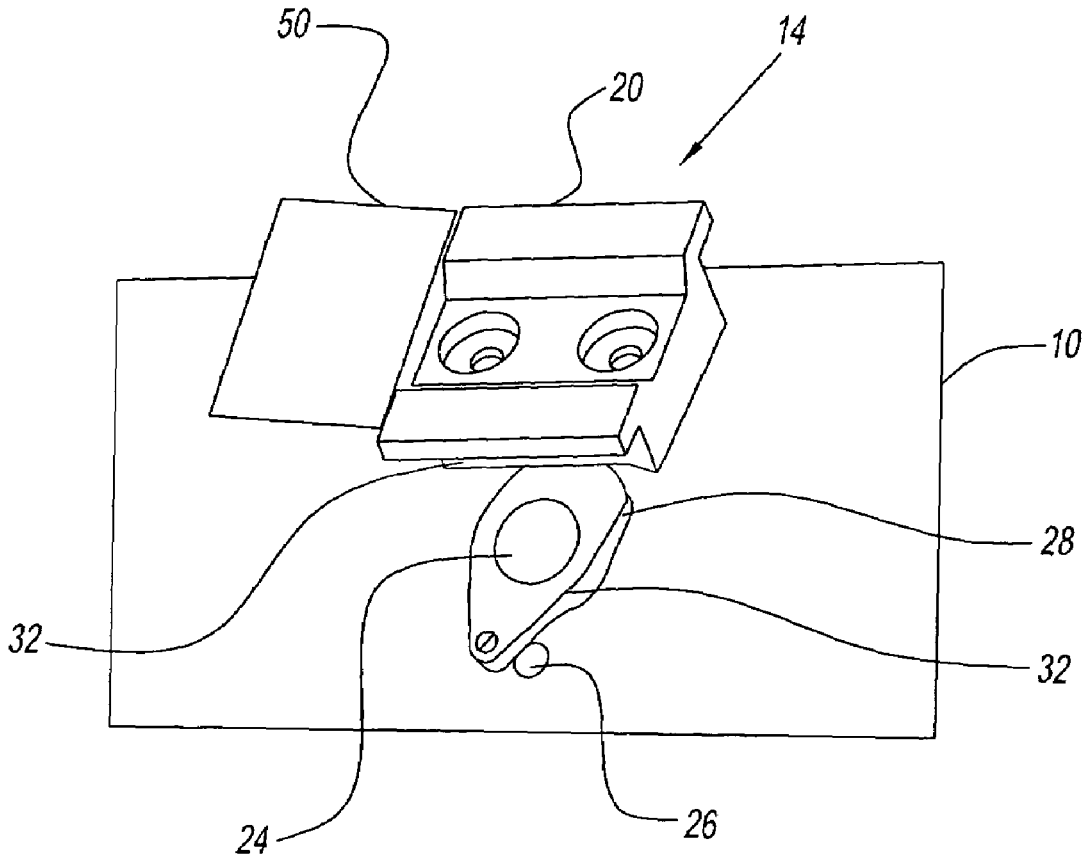
FIGS. 6A and 6B show different stages in the process of detaching the main body section of the hanger from the body of the missile.
Figure 6B:
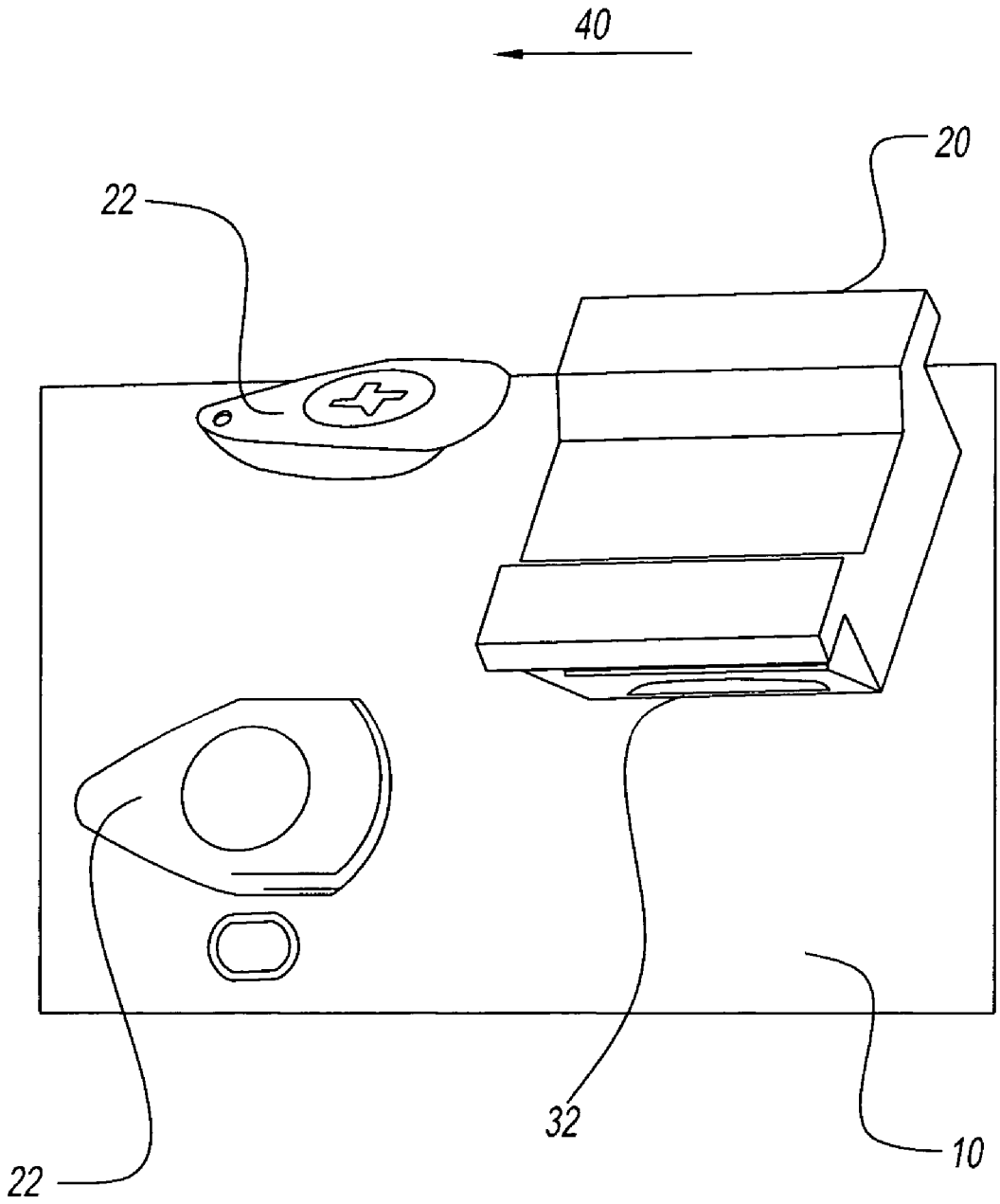

FIGS. 6A and 6B show different stages in the process of detaching the main body section of the hanger from the missile that take place at area 16 (FIG. 4) of the launch rail. Numeral 50 designates a stopper that is located in the slot in the launch rail and will be discussed in more detail with respect to FIGS. 7A and 7B hereinbelow. When the engine of missile 10 is fired, the missile begins to travel along the launch rail in the direction indicated in the figures by the arrow 40. As the missile travels, it is held to the launch rail by the hanger 14 with the projecting rails 30 of the main body section 20 of the hanger sliding in grooves 44 in the slot 42 in the launch rail 12, as described hereinabove. Located at the forward end of the slot in the launch rail is the stopper 50, which is rigidly attached to the bottom of the slot.

FIG. 6A shows the situation just after the first hanger assembly 14 strikes stopper 50. The force of the impact of the front end of the main body section 20 with stopper 50 creates shearing forces in the bolts 24,26 holding the clasps 22 to the body of the missile. Bolt 26 is designed to function as a shear pin, which breaks under the influence of shearing forces less than those created by the impact. When bolt 26 breaks clasp 22 begins to rotate about bolt 24. As the missile continues to move in the direction indicated by arrow 40, clasp 22 continues to rotate until end 28 eventually rotates out of groove 32.

FIG. 6B shows the situation after the main body section of the hanger assembly is released from the clasps and thus detached from the missile. The main body section remains attached to the launch rail by projecting rails 30 that remain in the grooves in the slot in the launch rail. As the missile continues to travel in the direction of arrow 40, the front of the second hanger assembly impacts upon the back of the first main body section, bolts 24 break and the main body section of the second hanger assembly is detached from the missile as described hereinabove.

Figure 7A:
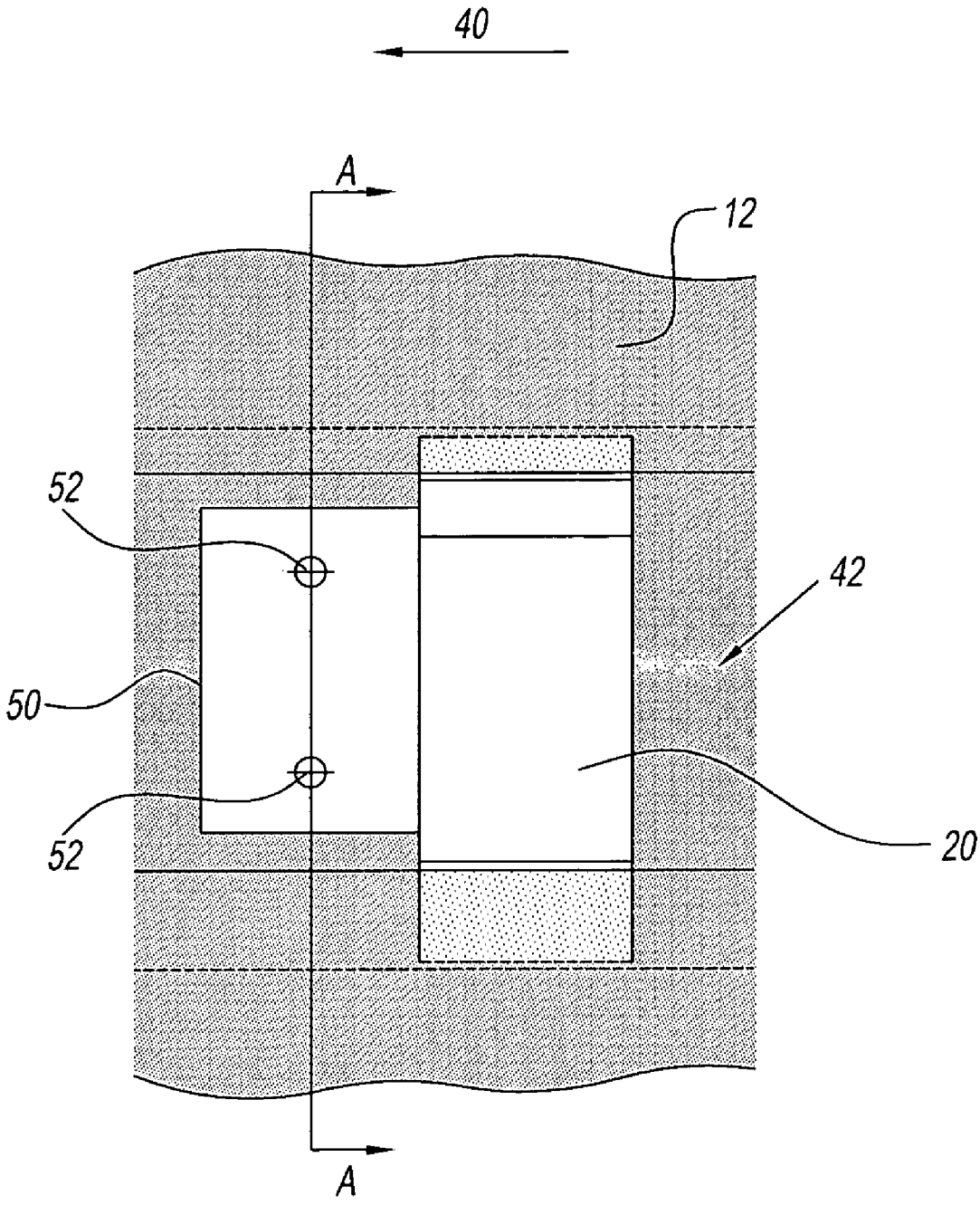
FIGS. 7A and 7B are respectively top and cross-sectional views of section 16 (FIG. 4) of the launch rail.
Figure 7B:
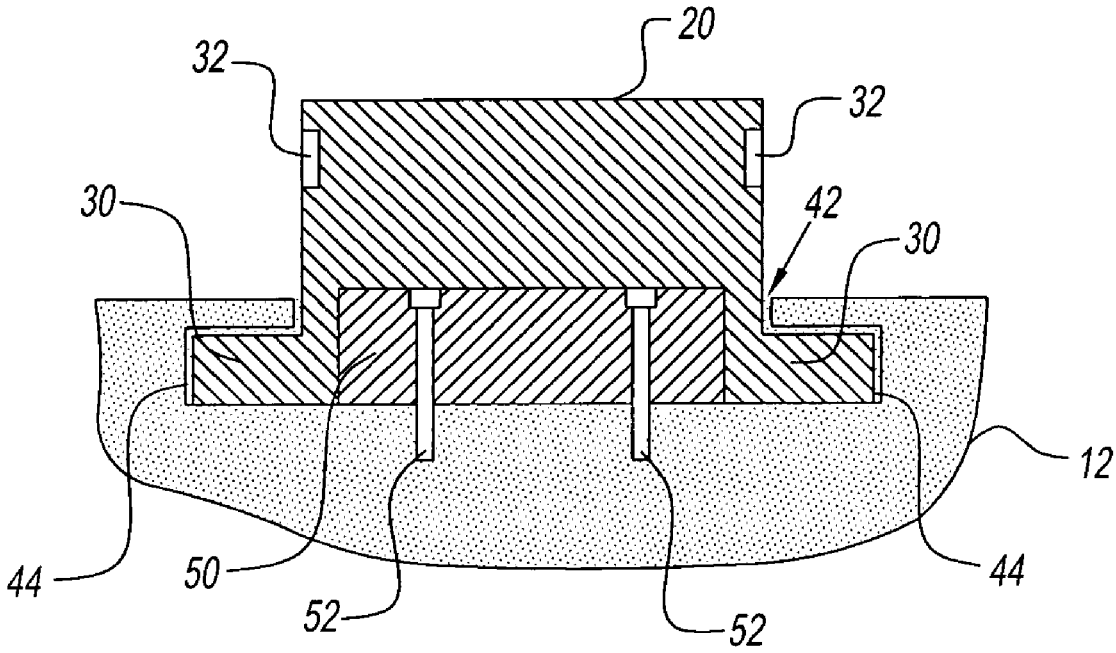

FIGS. 7A and 7B are respectively top and cross-sectional views of area 16 (FIG. 4) of the launch rail 12. FIGS. 7A and 7B correspond to the situation shown in FIG. 6B. Stopper 50 is attached to the bottom of slot 42 by means of bolts 52. The front edge of the main body section 20 of the first hanger assembly has impacted with the stopper and has been detached from the missile. As seen more clearly in FIG. 7B, main body section 20 is held to the launch rail 12 by means of projecting rails 30 that remain in grooves 44 in slot 42.

Figure 1:
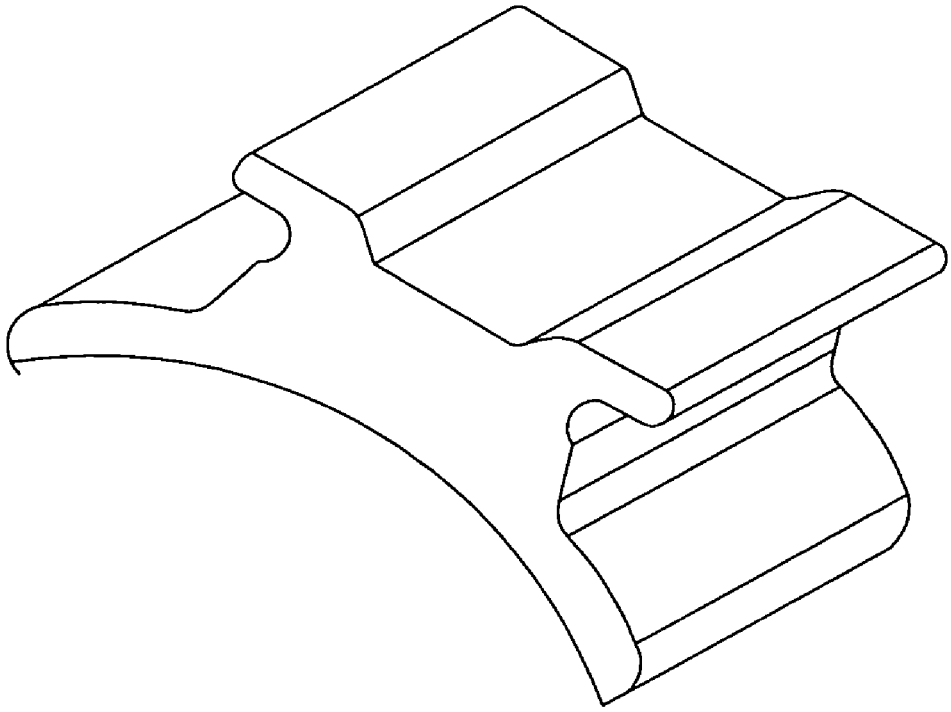
Fig. 1 (Prior Art)
FIG. 1 and FIG. 2 show a typical prior art hanger.
Figure 2:
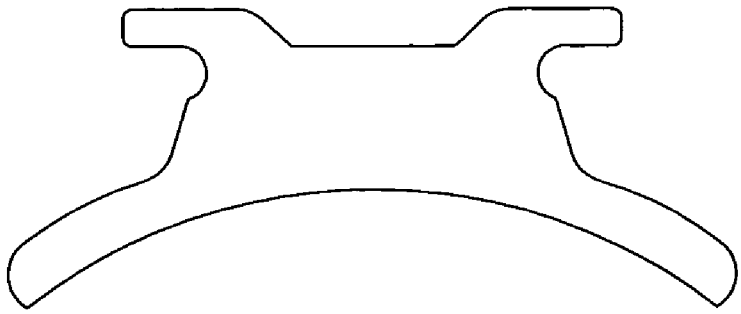
Fig. 2 (Prior Art)

When the missile leaves the launch rail, as shown in FIG. 4, the main body sections of the hanger assembly have been detached from the missile and are left behind, attached to the launch rail. Attached to the body of the missile, remain only the clasps 22. As indicated in FIG. 6B, the clasps can be orientated and shaped to minimize the resistance they provide to the flight of the missile. Comparing FIG. 6B to FIGS. 1 and 2, it is clear that the purpose of the invention, i.e. reduction of the additional drag factor on the missile caused by the hangers has been achieved.

Figure 8:
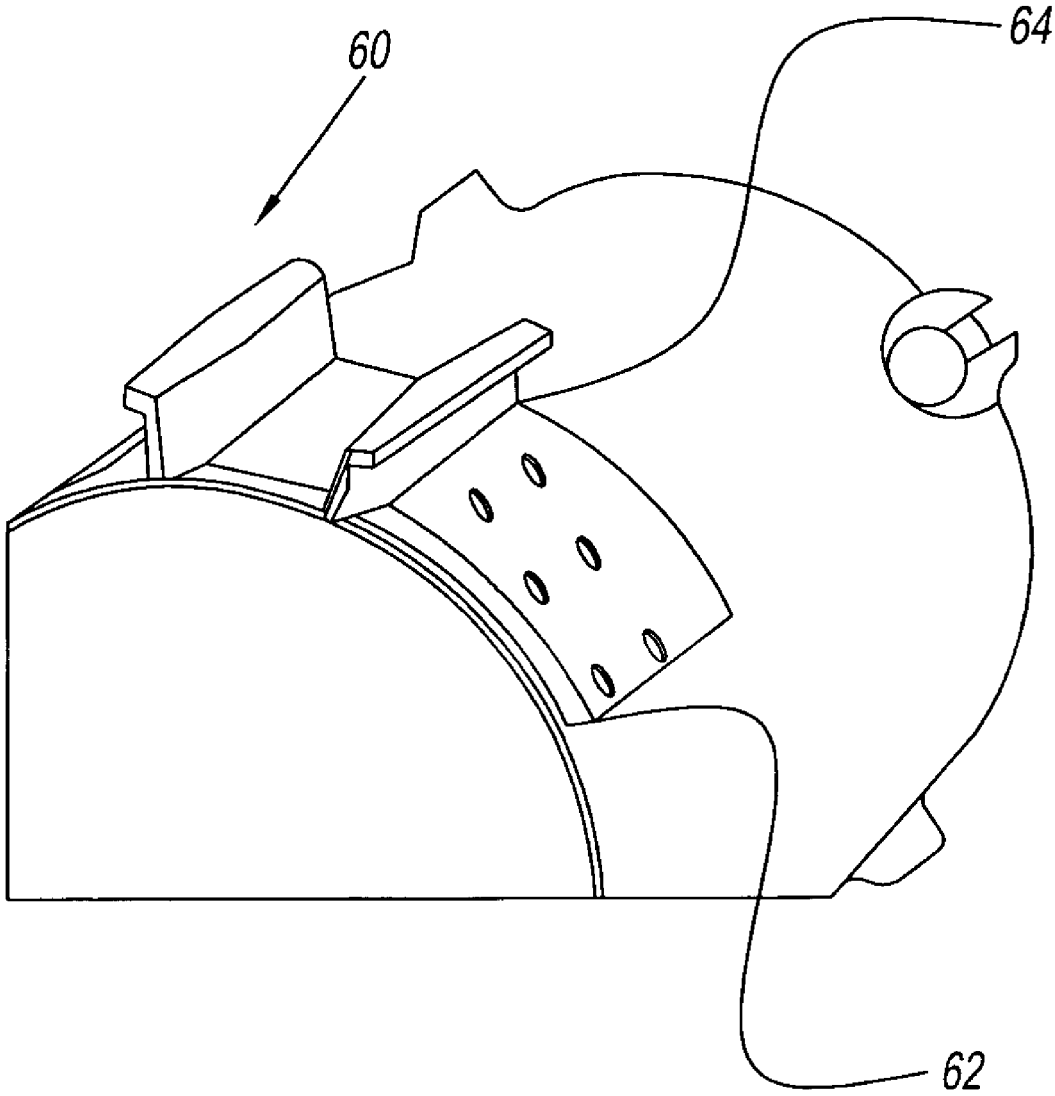
Fig. 8 (Prior Art)
FIGS. 8 and 9A show the retrofitting of a missile, replacing a conventional hanger with a detachable hanger of the invention.
Figure 9A:
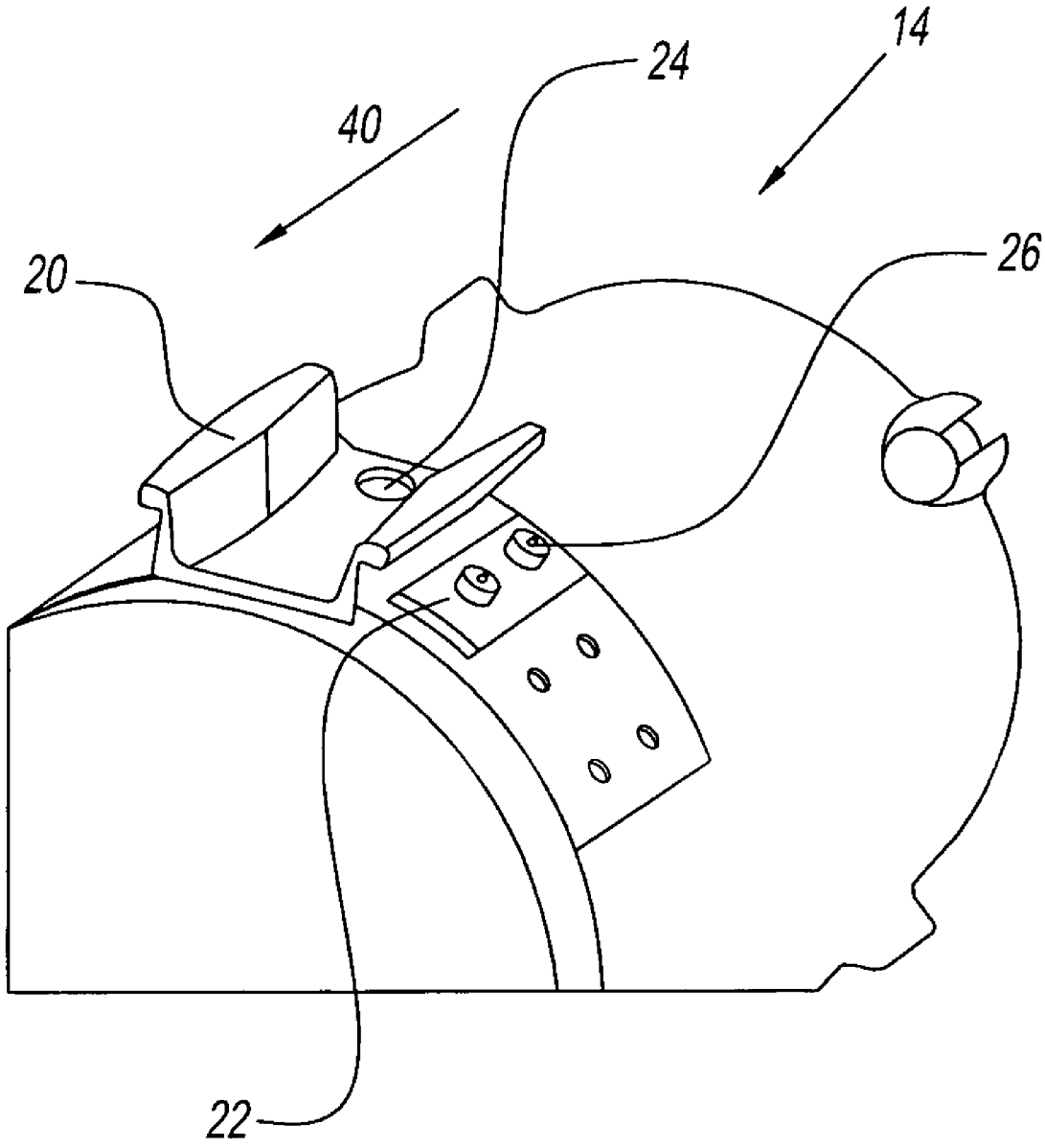

FIGS. 8 and 9A show a way of retrofitting a missile, replacing a conventional hanger with a detachable hanger of the invention. In FIG. 8 is shown a prior art hanger 60 attached to the rear of a missile (the tail fins are not shown for clarity). Hanger 60 is comprised of a single unit comprising a middle section suitable for attaching it to the launch rail and two flanges 62 which are bolted to the body of the missile by means of bolts 64. To retrofit the missile, hanger 60 is removed by removing bolts 64 and replaced by a hanger assembly of the invention, as shown in FIG. 9A.

Figure 9B:
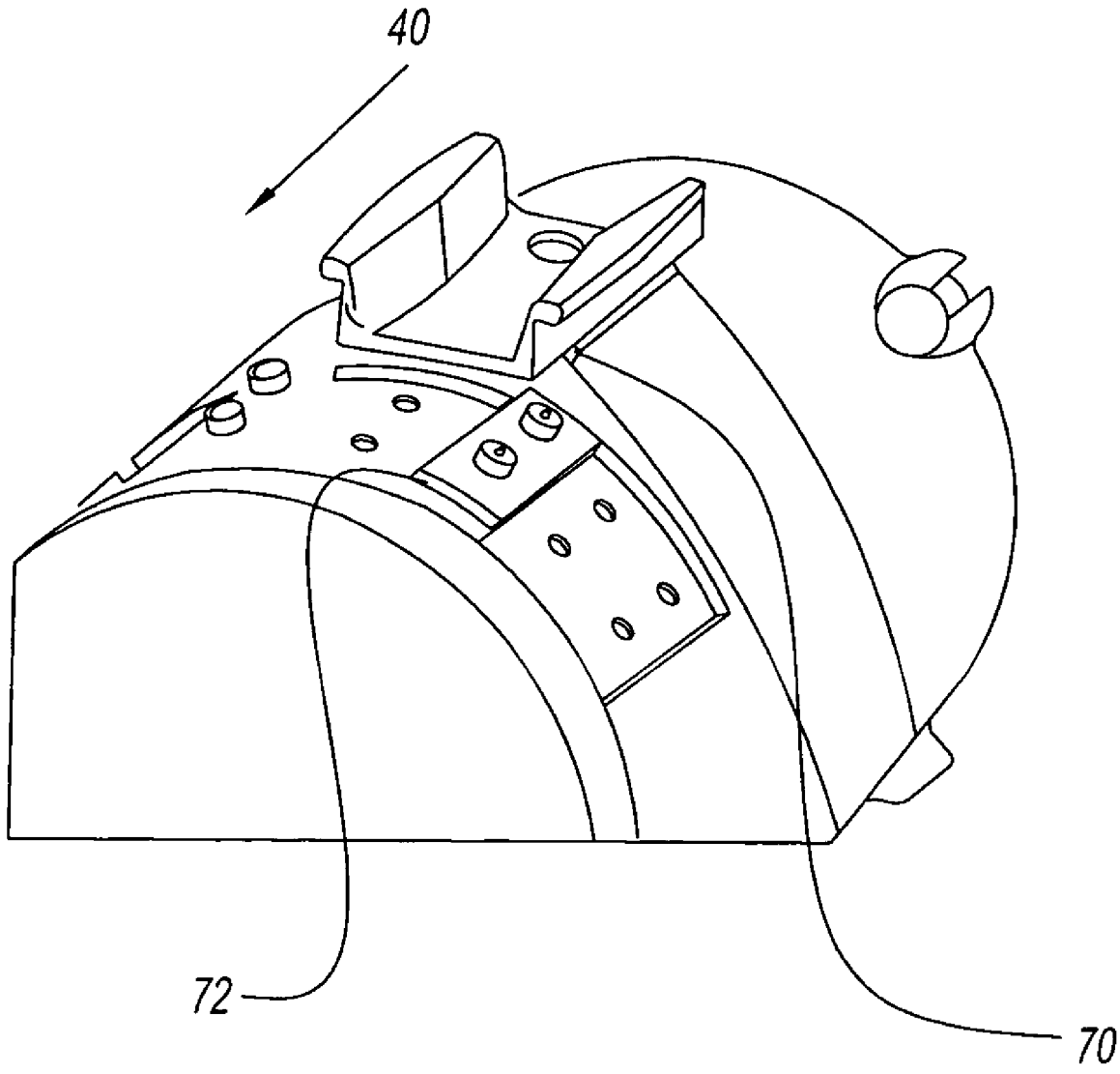

FIGS. 9A and 9B show another embodiment of the detachable hanger 14 of the invention. In this embodiment of the invention, a tongue 70 is formed on the surface of the sides of the main body section 20. Tongue 70 fits into groove 72 on clamps 22 to attach the main body section to the missile. Clamps 22 and main body section 20 are bolted to the missile by means of one or more bolts 26 and bolts 24 respectively. As in the embodiment described hereinabove, bolt 24 is designed to break when acted upon by shearing forces less than those created by the impact of the main body section of the hanger assembly with the stopper on the rail. Thus, during launching of the missile, the missile moves in the direction of arrow 40 until the main body section 20 of the hanger assembly reaches stopper 50. The force of the impact breaks bolt/s 24 and, as the missile continues to move relative to the launch rail, tongue 70 slides to the end of groove 72 and the main body section is detached from the body of the missile.

Although embodiments of the invention have been described by way of illustration, it will be understood that the invention may be carried out with many variations, modifications, and adaptations, without departing from its spirit or exceeding the scope of the claims.

The invention claimed is:

1. A system for launching a flying object from a launch platform comprising:

A. a rail assembly comprising:

a launch rail fixedly attached to said launch platform, said launch rail having a "T" shaped slot in it; the crossbar of said "T" forms two parallel grooves in said launch rail; and a stopper rigidly attached to the bottom of said "T" shaped slot at the forward end of said slot;

B. a hanger assembly comprising:

a "T" shaped main body section; the crossbar of said "T" forming two projecting rails that slidingly fit into said grooves in said launch rail; and one or more bolts, at least some of which break when experiencing shearing forces having a magnitude greater than a predetermined value, that are used to attach said main body section either directly or indirectly to said flying object;

characterized in that firing an engine of said flying object causes said flying object to move along said launch rail until said main body section impacts upon said stopper;

said impact causing at least some of said bolts to break detaching said main body section from said flying object, thereby launching said flying object from said launch platform while leaving said main body section behind in said rail.

2. A system according to claim 1, wherein the main body section is indirectly attached to the flying object by means of two or more clasps, which are attached to said flying object by at least two bolts;

characterized in that when said main body section impacts upon the stopper, all but one of said bolts break and said clasp rotates about the bolt which does not break, thereby detaching said main body section from said flying object.

3. A system according to claim 1, wherein the main body section is directly attached to the flying object by means of two or more bolts;

characterized in that, when said main body section impacts upon the stopper, all of said bolts break, thereby detaching said main body section from said flying object.

4. A system according to claim 1, wherein the flying object is chosen from the group comprising:

missiles, rockets, manned aircraft, and unmanned aircraft.

5. A system according to claim 1, wherein the launch platform is selected from the group comprising: land-based platforms, sea-based platforms, and airborne platforms.

* * * * *